US011946655B2

(12) United States Patent
Morimoto

(10) Patent No.: US 11,946,655 B2
(45) Date of Patent: Apr. 2, 2024

(54) HEATING AND HOT-WATER SUPPLY APPARATUS

(71) Applicant: NORITZ CORPORATION, Hyogo (JP)

(72) Inventor: Hiroshi Morimoto, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 387 days.

(21) Appl. No.: 17/290,771

(22) PCT Filed: Apr. 8, 2019

(86) PCT No.: PCT/JP2019/015299
§ 371 (c)(1),
(2) Date: May 2, 2021

(87) PCT Pub. No.: WO2020/110336
PCT Pub. Date: Jun. 4, 2020

(65) Prior Publication Data

US 2021/0372631 A1 Dec. 2, 2021

(30) Foreign Application Priority Data

Nov. 27, 2018 (JP) ..... 2018-220921

(51) Int. Cl.
*F24D 3/08* (2006.01)
*F24D 17/00* (2022.01)
*F24H 1/52* (2022.01)

(52) U.S. Cl.
CPC ..... *F24D 3/08* (2013.01); *F24D 17/00* (2013.01); *F24H 1/52* (2013.01)

(58) Field of Classification Search
CPC ... F24D 17/00; F24D 3/00; F24D 3/02; F24D 3/08; F24H 1/52; F24H 15/176; F24H 15/254

(Continued)

(56) References Cited

U.S. PATENT DOCUMENTS

2015/0096504 A1* 4/2015 Ando ..... G05B 23/0205 122/18.4
2016/0047558 A1* 2/2016 Shimada ..... F24D 3/02 237/63
2018/0120824 A1* 5/2018 Shimada ..... G05D 23/2754

FOREIGN PATENT DOCUMENTS

CN 201233054 5/2009
JP S5815696 3/1983

(Continued)

OTHER PUBLICATIONS

"International Search Report (Form PCT/ISA/210) of PCT/JP2019/015299", dated Jun. 25, 2019,with English traslation thereof, pp. 1-3.

*Primary Examiner* — Steven B McAllister
*Assistant Examiner* — John E Bargero
(74) *Attorney, Agent, or Firm* — JCIPRNET

(57) ABSTRACT

A heating and hot-water supply apparatus includes a combustion means, a heat exchanger, a circulation passage, a circulation means, a bypass passage, a distribution means, a hot-water supply heat exchanger, a water entry passage, a hot-water supply passage, and a control means. The circulation passage connects an external heating terminal and the heat exchanger. The water entry passage supplies water of an external hot-water supply pipe and an external water supply pipe to the hot-water supply heat exchanger. The control means controls the distribution means to be adaptable to each of a heating operation and a hot-water supply operation. The control means prioritizes the hot-water supply operation when there is a hot-water supply request for warm water use in addition to a heating request, and prioritizes the heating operation when there is a temperature-maintaining request for maintaining a temperature of the hot-water supply pipe in addition to the heating request.

6 Claims, 3 Drawing Sheets

(58) Field of Classification Search
USPC ..... 122/13.01
See application file for complete search history.

(56) References Cited

FOREIGN PATENT DOCUMENTS

| | | |
|---|---|---|
| JP | 4101845 | 6/2008 |
| JP | 4477566 | 6/2010 |
| JP | 2014163590 | 9/2014 |
| JP | 2018185082 | 11/2018 |

* cited by examiner

HEATING AND HOT-WATER SUPPLY APPARATUS

CROSS-REFERENCE TO RELATED APPLICATION

This application is a 371 application of the International PCT application serial no. PCT/JP2019/015299, filed on Apr. 8, 2019, which claims the priority benefits of Japan Patent Application No. 2018-220921, filed on Nov. 27, 2018. The entirety of each of the above-mentioned patent application is hereby incorporated by reference herein and made a part of this specification.

BACKGROUND

Technical Field

The disclosure relates to a heating and hot-water supply apparatus which heats and supplies a heating heat-medium used for heating to a heating terminal and performs hot water supply by using the heating heat-medium.

Related Art

Conventionally, a heating and hot-water supply apparatus is used to perform heating by using a heating heat-medium heated by combustion heat of a combustion part and supply hot water heated by the heat of the heating heat-medium. As such a heating and hot-water supply apparatus, for example, Patent Document 1 discloses a heating and hot-water supply apparatus which switches between a heating operation and a hot-water supply operation by switching a flow path of a heating heat-medium.

The heating and hot-water supply apparatus of Patent Document 1 includes a combustion part which burns a fuel, a heat exchanger which exchanges heat between a high-temperature combustion gas generated in the combustion part and a heating heat-medium, and a hot-water supply heat exchanger which exchanges heat between the heating heat-medium and water for hot water supply. In the heating operation, the heating heat-medium is circulated between the heat exchanger and the heating terminal. In the hot-water supply operation, hot water heated by the hot-water supply heat exchanger by the heating heat-medium is supplied.

Further, for example, as disclosed in Patent Document 2, by supplying tap water heated by a heat source machine to a hot water tap and supplying the heated tap water to a heating terminal, a heating and hot-water supply apparatus is configured to be able to perform a simultaneous heating and hot-water supply operation in which a hot-water supply operation and a heating operation are performed at the same time. During the simultaneous heating and hot-water supply operation, the heating and hot-water supply apparatus performs hot-water supply priority control of reducing the flow rate of the heated tap water supplied to the heating terminal to prioritize hot water supply.

RELATED ART DOCUMENTS

Patent Documents

Patent Document 1: Japanese Patent No. 4477566

Patent Document 2: Japanese Patent Application Laid-Open No. 2014-163590

SUMMARY

Problems to be Solved

Also, an instantaneous hot-water system is widely used, and in the instantaneous hot-water system, warm water is prepared by circulating water of a hot-water supply setting temperature to a hot-water supply pipe provided with a hot water tap, and warm water can be used from the hot water tap upon opening the hot water tap. A hot-water supply apparatus of the instantaneous hot-water system performs an instantaneous hot water operation in which warm water is circulated in the hot-water supply pipe and the water is heated if necessary, in order to maintain the temperature of the warm water of the hot-water supply pipe. Further, when the warm water of the hot-water supply pipe is supplied from the hot water tap, tap water equivalent to the amount of warm water used is supplied to the hot-water supply apparatus, and the hot-water supply apparatus heats and supplies the tap water to the hot-water supply pipe. Accordingly, the hot-water supply apparatus of the instantaneous hot-water system performs a hot-water supply operation of supplying heated warm water to the hot-water supply pipe in both the case of warm water use from the hot water tap and the case of the instantaneous hot water operation.

In the case where the hot-water supply apparatus of the instantaneous hot-water system is a heating and hot-water supply apparatus which also performs a heating operation as in Patent Document 1, when the hot-water supply operation is started during the heating operation, as in Patent Document 2, the hot-water supply operation is generally prioritized over the heating operation and the heating operation is suspended. In the case of a hot-water supply operation for warm water use from the hot water tap, it is preferable that the hot-water supply operation is prioritized, but if a hot-water supply operation for maintaining the temperature of the hot-water supply pipe is prioritized, the heating operation may be suspended for a long time depending on the use environment of the instantaneous hot-water system, and there is a possibility that comfort of a user will be impaired by simply prioritizing the hot-water supply operation.

An objective of the disclosure is to provide a heating and hot-water supply apparatus capable of changing an operation to be prioritized according to a purpose of a hot-water supply operation.

Means for Solving the Problems

A heating and hot-water supply apparatus according to a first aspect includes a combustion means, a heat exchanger, a circulation passage, a circulation means, a bypass passage, a distribution means, a hot-water supply heat exchanger, a water entry passage, a hot-water supply passage, and a control means. The heat exchanger heats a heating heat-medium by heat generated by the combustion means. The circulation passage connects an external heating terminal and the heat exchanger. The circulation means is arranged in the circulation passage to circulate the heating heat-medium. The bypass passage is branched off from the circulation passage and bypasses the heating terminal. The distribution means is arranged at a branching part of the bypass passage. The hot-water supply heat exchanger is arranged in the bypass passage. The water entry passage supplies water of an external hot-water supply pipe and an external water supply pipe to the hot-water supply heat exchanger. The hot-water supply passage supplies water heated by the hot-water supply heat exchanger to the hot-water supply pipe at a predetermined hot-water supply setting temperature. The control means controls the distribution means to be adaptable to each of a heating operation of supplying the heating heat-medium to the heating terminal and a hot-water supply operation of supplying hot water to the hot-water supply pipe. The control means prioritizes the hot-water supply operation when there is a hot-water supply request for warm water use in addition to a heating request, and prioritizes the heating operation when there is a temperature-maintaining request for maintaining a temperature of the hot-water supply pipe in addition to the heating request.

According to the above configuration, when there is a heating request in the heating and hot-water supply apparatus capable of performing the heating operation of supplying the heated heating heat-medium to the external heating terminal and the hot-water supply operation of supplying hot water to the external hot-water supply pipe, in the case where there is a hot-water supply request for the purpose of warm water use, the hot-water supply operation is prioritized, and in the case where there is a temperature-maintaining request for the purpose of maintaining the temperature of the hot-water supply pipe, the heating operation is prioritized. Accordingly, the operation to be prioritized can be changed according to the purpose of the hot-water supply operation, and the comfort of the user can be improved.

In a preferred first form, an operation terminal communicably connected to the control means is included. When there is the temperature-maintaining request in addition to the heating request, if the temperature-maintaining request is due to an operation of the operation terminal, the control means prioritizes the hot-water supply operation for a predetermined period starting from when the temperature-maintaining request is made.

According to the above configuration, when there is the temperature-maintaining request in addition to the heating request, the heating operation is prioritized, but if the temperature-maintaining request is due to an operation of the operation terminal, the hot-water supply operation is prioritized to maintain the temperature of the hot-water supply pipe for a predetermined period starting from when the temperature-maintaining request is made. Accordingly, when there is a temperature-maintaining request based on the operation of the user, it is possible to change to prioritize the hot-water supply operation to improve the comfort of the user.

In a preferred second form, an incoming water temperature detection means is included. The incoming water temperature detection means is provided in the water entry passage and detects an incoming water temperature of water entering the hot-water supply heat exchanger. When there is the temperature-maintaining request in addition to the heating request, the control means prioritizes the hot-water supply operation during a period in which the incoming water temperature is lower than a predetermined temperature determined according to the hot-water supply setting temperature.

According to the above configuration, when there is the temperature-maintaining request in addition to the heating request, the heating operation is prioritized, but the hot-water supply operation is prioritized to maintain the temperature of the hot-water supply pipe for a period in which the incoming water temperature is lower than the predetermined temperature determined according to the hot-water supply setting temperature. Accordingly, warm water at a low temperature down to the predetermined temperature is allowed and the heating operation is prioritized even if there is a temperature-maintaining request due to a temperature lower than the hot-water supply setting temperature upon confirmation of the temperature of the warm water of the hot-water supply pipe. Therefore, it is possible to improve the comfort of the user who does not use warm water. Further, since it is possible to change to prioritize the hot-water supply operation to maintain the temperature of the hot-water supply pipe if the temperature is lower than the predetermined temperature, it is possible to maintain the temperature of the warm water at the predetermined temperature or higher in preparation for warm water use so as not to impair the comfort of the user of warm water.

In a preferred third form, an incoming water temperature detection means is included. The incoming water temperature detection means is provided in the water entry passage and detects an incoming water temperature of water entering the hot-water supply heat exchanger. When there is the temperature-maintaining request in addition to the heating request, the control means prioritizes the hot-water supply operation during a period in which a temperature difference obtained by subtracting the incoming water temperature from the hot-water supply setting temperature is equal to or greater than a predetermined value.

According to the above configuration, when there is the temperature-maintaining request in addition to the heating request, the heating operation is prioritized, but the hot-water supply operation for maintaining the temperature of the hot-water supply pipe is prioritized during a period in which the temperature difference between the hot-water supply setting temperature and the incoming water temperature is equal to or greater than the predetermined value. Accordingly, warm water of a temperature lower than the hot-water supply setting temperature by up to the predetermined value is allowed and the heating operation is prioritized even if there is the temperature-maintaining request due to a temperature lower than the hot-water supply setting temperature upon confirmation of the temperature of the warm water of the hot-water supply pipe. Therefore, it is possible to improve the comfort of the user who does not use warm water. Further, since it is possible to change to prioritize the hot-water supply operation to maintain the temperature of the hot-water supply pipe during a period in which the temperature difference is equal to or greater than the predetermined value, the temperature of the warm water can be maintained at or above a temperature lower than the hot-water supply setting temperature by the predetermined value in preparation for warm water use so as not to impair the comfort of the user of warm water.

Effects

According to the heating and hot-water supply apparatus of the application, since an operation to be prioritized can be changed according to a purpose of a hot-water supply operation, comfort of a user can be improved.

DESCRIPTION OF THE EMBODIMENTS

Hereinafter, the configuration for implementing the disclosure will be described based on the embodiment.

Embodiment

Figure 1:
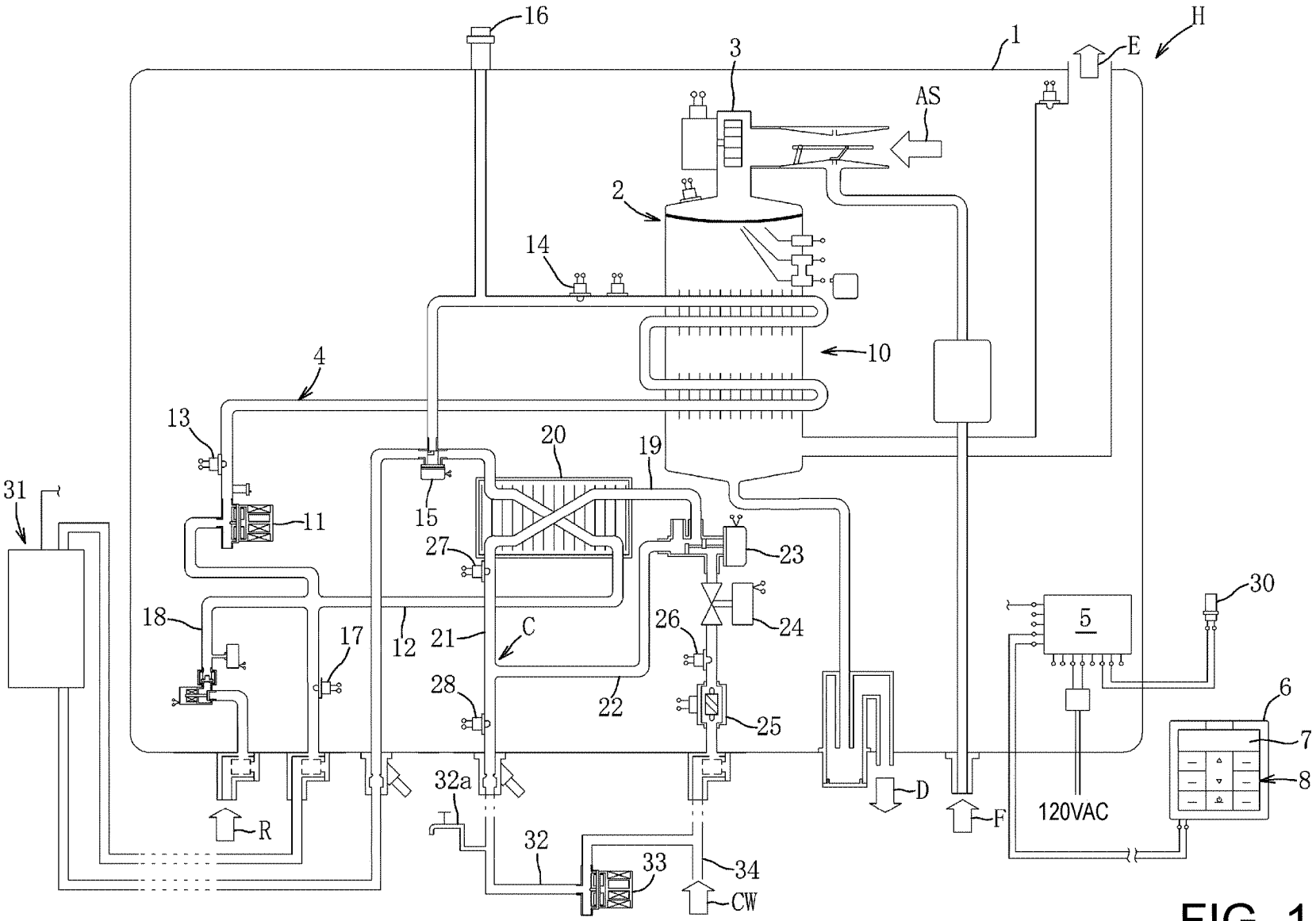
FIG. 1 is a view showing a configuration of a heating and hot-water supply apparatus according to an embodiment of the disclosure.

First, the overall configuration of a heating and instantaneous hot-water system H including a heating and hot-water supply apparatus 1 of the disclosure and a heating terminal 31 will be described based on FIG. 1.

The heating and instantaneous hot-water system H is configured to perform heating by supplying a heating heat-medium heated by the heating and hot-water supply apparatus 1 to the heating terminal 31, and supply the water heated by utilizing the heat of the heating heat-medium to a hot-water supply pipe 32 so that warm water is used from a hot water tap 32*a* arranged to the hot-water supply pipe 32.

The heating terminal 31 is a known heating device such as a floor heating device having a heat transfer tube for transferring the heat of the heating heat-medium, for example, to the floor of a room, or a radiator which naturally convects air heated by the heat of the heating heat-medium. The heating heat-medium used for heating returns to the heating and hot-water supply apparatus 1 for re-heating. The hot-water supply pipe 32 is arranged to extend from the heating and hot-water supply apparatus 1, pass through multiple warm water use spots such as a kitchen, a washroom, and a bathroom of a house, and return to the heating and hot-water supply apparatus 1. A hot water tap is arranged at each warm water use spot, and the hot water tap 32*a* is, for example, a hot water tap in the bathroom. The hot-water supply pipe 32 is provided with a warm-water circulation pump 33 for circulating warm water during an instantaneous hot water operation.

Next, the heating and hot-water supply apparatus 1 will be described.

The heating and hot-water supply apparatus 1 is configured to be capable of respectively performing a heating operation of supplying a heating heat-medium heated by utilizing combustion heat of a combustion part 2 to the heating terminal 31 provided outside the heating and hot-water supply apparatus 1, and a hot-water supply operation of adjusting fed water to a hot-water supply setting temperature using the heat of the heating heat-medium and supplying the hot water to the external hot-water supply pipe 32. The hot-water supply operation may include the case of adjusting tap water to the hot-water supply setting temperature to supply hot water, and the case of an instantaneous hot water operation of circulating warm water of the hot-water supply pipe 32 to maintain the temperature of the warm water and heating the water if necessary.

The heating and hot-water supply apparatus 1 includes a combustion part 2 which is a combustion means, a heat exchanger 10, a circulation passage 4 connecting the heat exchanger 10 and the external heating terminal 31, and a circulation pump 11 which is a circulation means of the heating heat-medium and is provided on the inlet side (upstream side) of the heat exchanger 10 in the circulation passage 4. The combustion part 2 includes a combustion blower 3, and a mixed gas supplied by mixing, by the combustion blower 3, an air supply indicated by an arrow AS and a fuel gas indicated by an arrow F is burned at the combustion part 2. The amount of the combustion gas and the combustion heat generated are adjusted by the rotation speed of the combustion blower 3. The heat exchanger 10 exchanges heat between the combustion gas generated in the combustion part 2 and the circulating heating heat-medium to heat the heating heat-medium to a set temperature. The combustion gas of which the temperature has dropped due to the heat exchange is exhausted to the outside as indicated by an arrow E.

In addition, the heating and hot-water supply apparatus 1 includes a first bypass passage 12 (bypass passage), a hot-water supply heat exchanger 20 provided in the first bypass passage 12, a water entry passage 19, and a hot-water supply passage 21. To bypass the heating terminal 31, the first bypass passage 12 is branched off from the circulation passage 4 on the outlet side (downstream side) of the heat exchanger 10 and is connected to the circulation passage 4 on the inlet side (upstream side) of the circulation pump 11. The water entry passage 19 supplies tap water supplied from an external water supply pipe 34 as indicated by an arrow CW to the hot-water supply heat exchanger 20. The hot-water supply passage 21 supplies water heated by the hot-water supply heat exchanger 20 to the external hot-water supply pipe 32.

Next, the circulation passage 4 will be described.

The circulation passage 4 includes a first temperature sensor 13 between the circulation pump 11 and the heat exchanger 10, and includes a second temperature sensor 14 on the outlet side of the heat exchanger 10. The first temperature sensor 13 detects the temperature of the heating heat-medium flowing into the heat exchanger 10. The second temperature sensor 14 detects the temperature of the heating heat-medium heated by the heat exchanger 10.

A first distribution valve 15 which is a distribution means of the circulating heating heat-medium is provided at a branching part at which the first bypass passage 12 is branched off from the circulation passage 4 on the outlet side of the heat exchanger 10. The first distribution valve 15 distributes the heating heat-medium heated by the heat exchanger 10 to the circulation passage 4 and the first bypass passage 12. The first distribution valve 15 is adjusted so that in the heating operation, the full amount of the heating heat-medium is supplied to the heating terminal 31 on the heating side, and in the hot-water supply operation, the full amount of the heating heat-medium is supplied to the hot-water supply heat exchanger 20 on the hot-water supply side. In other words, the distribution ratio of the first distribution valve 15 is adjusted to be adaptable to each of the heating operation and the hot-water supply operation. The distribution ratio may be adjusted so that the first distribution valve 15 distributes the heating heat-medium to the heating side and the hot-water supply side to simultaneously perform the heating operation and the hot-water supply operation. The distribution means may also be a switching valve (three-way valve) for switching the flow path of the heating heat-medium to the heating side or the hot-water supply side.

A pressure release valve 16 for releasing the pressure in the circulation passage 4 is provided between the heat exchanger 10 and the first distribution valve 15. A heating return temperature sensor 17 for detecting the temperature of the heating heat-medium returning from the heating terminal 31 is provided on the upstream side of the circulation pump 11. A replenishment passage 18 for replenishing the heating heat-medium as indicated by an arrow R is connected between the circulation pump 11 and the heating return temperature sensor 17.

Next, the hot-water supply heat exchanger 20 will be described.

The hot-water supply heat exchanger 20 is a plate-type heat exchanger with passages formed among multiple stacked heat exchange plates. In the hot-water supply heat exchanger 20, the heating heat-medium and the water supplied from the water entry passage 19 flow alternately in the passages between the heat exchange plates in directions toward each other without mixing with each other. The heat exchange plates are formed with protrusions and indentations to increase the surface area and improve the heat exchange efficiency.

Next, the water entry passage 19 and the hot-water supply passage 21 will be described.

The water entry passage 19 includes a second distribution valve 23, a flow rate adjustment valve 24, a hot-water supply flow rate sensor 25, and an incoming water temperature sensor 26 (incoming water temperature detection means). By opening the hot water tap 32*a*, tap water is supplied to the water entry passage 19 as indicated by the arrow CW. Further, by the driving of the warm-water circulation pump 33, warm water of the hot-water supply pipe 32 is supplied to the water entry passage 19.

A second bypass passage 22 which bypasses the hot-water supply heat exchanger 20 is branched off from the water entry passage 19. The second distribution valve 23 arranged at the branching part distributes water to the water entry passage 19 and the second bypass passage 22, and the distribution ratio is adjustable. The flow rate adjustment valve 24 adjusts the flow rate of water entering the second distribution valve 23. The hot-water supply flow rate sensor 25 detects the flow rate of water supplied to the second distribution valve 23. The incoming water temperature sensor 26 detects the temperature of water entering the second distribution valve 23, i.e., an incoming water temperature of the water entering the hot-water supply heat exchanger 20.

The second bypass passage 22 is connected to the hot-water supply passage 21 at a junction part C. A hot-water delivery temperature sensor 27 provided between the junction part C and the hot-water supply heat exchanger 20 detects the temperature of the water heated by the hot-water supply heat exchanger 20. A hot-water supply temperature sensor 28 provided at the downstream end of the hot-water supply passage 21 detects the temperature of the warm water supplied to the hot-water supply pipe 32 mixed from the water heated by the hot-water supply heat exchanger 20 and the water flowing through the second bypass passage 22. In the hot-water supply operation, the second distribution valve 23 and the like are controlled so that this temperature can become a preset hot-water supply setting temperature.

Next, a control part 5 (control means) will be described.

The heating and hot-water supply apparatus 1 includes a control part 5 which controls the heating operation and the hot-water supply operation. The control part 5 is communicably connected to an operation terminal 6 for performing a setting operation of the hot-water supply setting temperature, a start operation of the heating operation, operations (a start operation of the instantaneous hot water operation) for bringing the temperature of the warm water of the hot-water supply pipe 32 to the hot-water supply setting temperature, and the like. The operation terminal 6 is arranged, for example, in a room where the heating terminal 31 performs heating, and includes a display part 7 capable of displaying various temperatures, operating conditions, etc., a switch part 8 for performing a setting operation, a start operation of the heating operation, etc., and an audio output part (not shown) for outputting an alarm sound, etc. Further, an outside air temperature sensor 30 arranged outdoors is communicably connected to the control part 5.

The control part 5 is connected so that the detection temperatures of the first temperature sensor 13 and the like and the rotation speeds of the combustion blower 3, the circulation pump 11, and the like can be received, and further, the rotation speed of the combustion blower 3 and the rotation speeds of the circulation pump 11 and the warm-water circulation pump 33 can be adjusted, and the distribution ratios of the first distribution valve 15 and the second distribution valve 23 can be adjusted. Accordingly, the heating operation, the hot-water supply operation, and the like are controlled.

Next, the heating operation will be described.

With a start operation of the heating operation by a user of the heating and instantaneous hot-water system H, or upon a start time of the heating operation set by the user using a timer function, a heating request is inputted to the control part 5. The heating request is inputted to the control part 5 until the heating operation is ended by an end operation of the heating operation or the like. The heating terminal 31 may be communicably connected to the control part 5, and the heating request may be inputted to the control part 5 by a start operation of the heating operation at the heating terminal 31.

When the heating request is inputted to the control part 5, the control part 5 turns on combustion of the combustion part 2, drives the circulation pump 11, and adjusts the first distribution valve 15 so that the full amount of the heating heat-medium heated by the heat exchanger 10 circulates between the heat exchanger 10 and the heating terminal 31. Then, the heating operation is performed by supplying the heating heat-medium heated by the heat exchanger 10 to the heating terminal 31, and heating the heating heat-medium returned from the heating terminal 31 by the heat exchanger 10.

Next, the hot-water supply operation will be described.

When the hot-water supply flow rate sensor 25 detects a flow rate equal to or higher than a predetermined flow rate set in advance due to opening of the hot water tap 32*a* by the user of the heating and instantaneous hot-water system H, a hot-water supply request is inputted to the control part 5. The opening of the hot water tap 32*a* during the instantaneous hot water operation may be determined based on detection of a flow rate equal to or higher than the predetermined flow rate by the hot-water supply flow rate sensor 25, together with an incoming water temperature lowered due to entry of low-temperature tap water into the hot-water supply heat exchanger 20. During the period in which the hot-water supply flow rate sensor 25 detects a flow rate equal to or higher than the predetermined flow rate, the hot-water supply request is inputted to the control part 5.

With a start operation of the instantaneous hot water operation by the user of the heating and instantaneous hot-water system H, or when the warm water is less than the hot-water supply setting temperature in a temperature confirmation of the warm water of the hot-water supply pipe 32 performed by the control part 5 during the instantaneous hot water operation, a temperature-maintaining request is inputted to the control part 5. The temperature-maintaining request is inputted to the control part 5 for a predetermined period after the start operation of the instantaneous hot water operation and during a period in which the warm water of the hot-water supply pipe 32 is less than the hot-water supply setting temperature. The start operation of the instantaneous hot water operation by the user includes when the start time of the instantaneous hot water operation set by the user using a timer function has come. In addition, the temperature confirmation of the warm water during the instantaneous hot water operation is performed by driving the warm-water circulation pump 33 constantly or periodically (e.g., every 10 minutes) to circulate the warm water to maintain the temperature of the warm water of the hot-water supply pipe 32 even if the warm water is not used, and detecting the temperature of the warm water by the incoming water temperature sensor 26.

When the hot-water supply request or the temperature-maintaining request is inputted to the control part 5, the control part 5 turns on combustion of the combustion part 2, drives the circulation pump 11, and adjusts the first distribution valve 15 so that the full amount of the heating heat-medium heated by the heat exchanger 10 is supplied to the hot-water supply heat exchanger 20. Then, the hot-water supply operation is performed by adjusting the water heated by the hot-water supply heat exchanger 20 by heat exchange with the heating heat-medium to the hot-water supply setting temperature in the hot-water supply passage 21 and supplying the water to the hot-water supply pipe 32. At this time, the distribution ratio of the second distribution valve 23 is adjusted based on the detection temperatures of the incoming water temperature sensor 26 and the hot-water delivery temperature sensor 27 so that the detection temperature of the hot-water supply temperature sensor 28 is brought to the hot-water supply setting temperature, and the water of the second bypass passage 22 is mixed with the water heated by the hot-water supply heat exchanger 20 in the hot-water supply passage 21 and supplied to the hot-water supply pipe 32. The distribution ratio and the like of the second distribution valve 23 may be further adjusted based on the detection temperature of the hot-water supply temperature sensor 28. The heating heat-medium heated by the heat exchanger 10 exchanges heat with the water supplied from the water entry passage 19 at the hot-water supply heat exchanger 20 and then flows into the circulation passage 4 and returns to the heat exchanger 10.

As described above, the heating and hot-water supply apparatus 1 performs the heating operation of supplying the heating heat-medium to the heating terminal 31 when there is a heating request, and performs the hot-water supply operation of supplying warm water of the hot-water supply setting temperature to the hot-water supply pipe 32 when there is a hot-water supply request or a temperature-maintaining request. When there is a hot-water supply request in addition to the heating request, the hot-water supply operation is prioritized. When there is a temperature-maintaining request in addition to the heating request, the heating operation is basically prioritized, but when predetermined conditions are satisfied for the temperature-maintaining request, the hot-water supply operation is prioritized instead. The predetermined conditions are:

The temperature-maintaining request is made by an operation of the operation terminal 6 by the user; (Condition 1)

The incoming water temperature is lower than a predetermined temperature determined according to the hot-water supply setting temperature (hot-water supply setting temperature≥predetermined temperature), or a temperature difference between the incoming water temperature and the hot-water supply setting temperature (temperature difference=hot-water supply setting temperature−incoming water temperature) is equal to or greater than a predetermined value. (Condition 2)

When either one of Condition 1 and Condition 2 is satisfied, the hot-water supply operation is prioritized.

The predetermined temperature is determined considering, for example, that the higher the temperature of the warm water is, the greater the heat dissipation in the hot-water supply pipe 32 is and the greater the waste is, and that comfort is impaired when the difference between the warm water temperature right after the opening of the hot water tap 32*a* and the hot-water supply setting temperature increases. Specifically, when the hot-water supply setting temperature is Tt and the predetermined temperature is Tr, for example, the predetermined temperature Tr is determined by the hot-water supply setting temperature Tt based on an arithmetic expression such as Tr=Tt/2+16(Tt≥32)[° C.]. With an emphasis on comfort, for example, the predetermined value of the temperature difference is set to a temperature (e.g., 3° C.) at which the difference between the temperature of the warm water used right after the opening of the hot water tap 32*a* and the hot-water supply setting temperature does not become too large.

Figure 2:
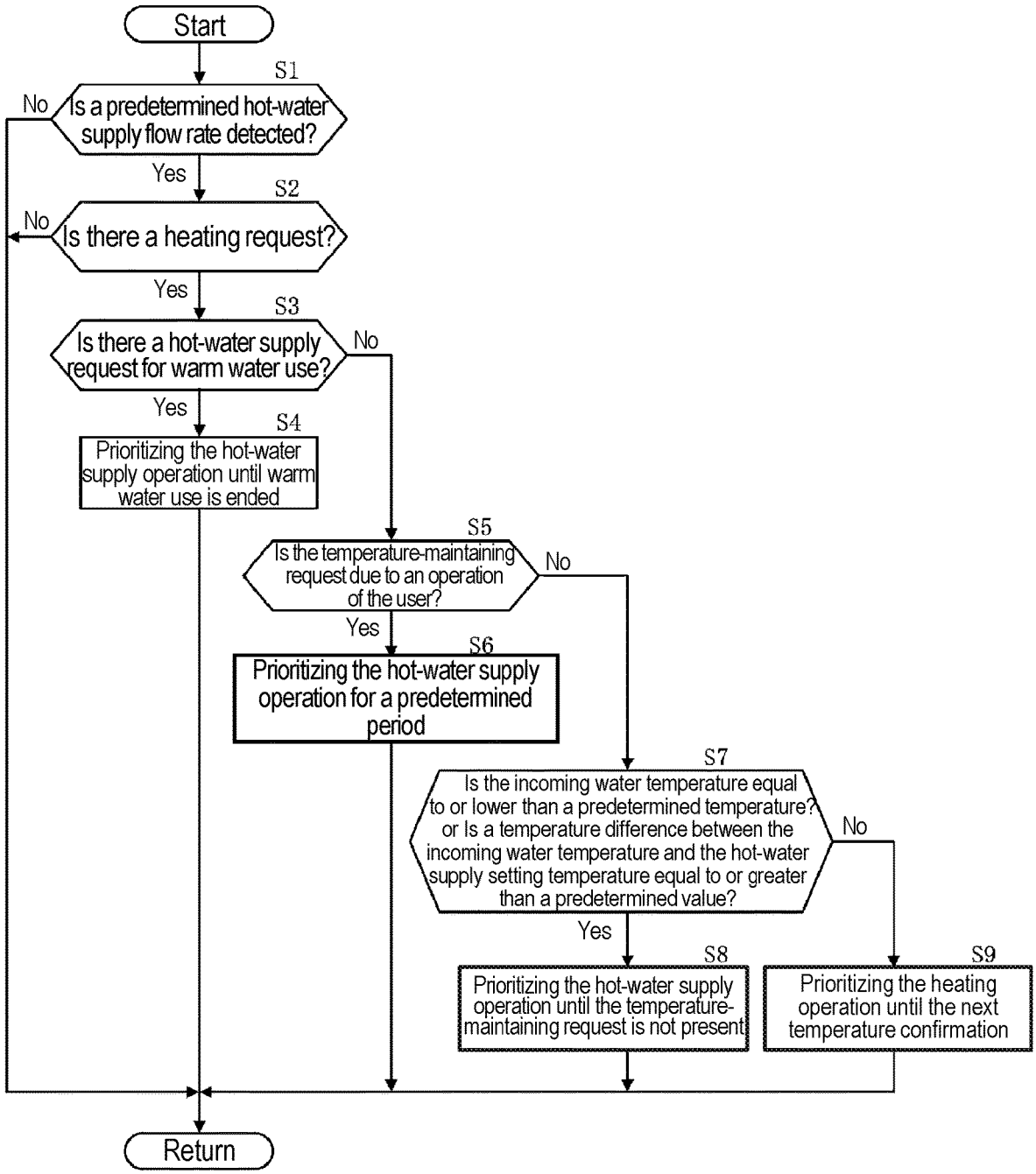
FIG. 2 is a flowchart of priority determination control according to an embodiment of the disclosure.

The flowchart of FIG. 2 shows an example of priority determination control of the control part 5 for determining which of the heating operation and the hot-water supply operation is to be prioritized when there is a temperature-maintaining request in addition to the heating request. In the figure, Si (i=1, 2, . . . ) represents a step.

First, in S1, it is determined whether the hot-water supply flow rate sensor 25 has detected a predetermined hot-water supply flow rate or higher. If the determination is "Yes", the process proceeds to S2, and if the determination is "No", priority determination is not performed since the hot-water supply operation is not performed, and the process returns. Next, in S2, it is determined whether there is a heating request. If there is a heating request and the determination is "Yes", the process proceeds to S3, and if the determination is "No", priority determination is not performed since the heating operation is not performed, and the process returns.

Next, in S3, with respect to the hot-water supply operation started by the determination of S1, it is determined whether there is a hot-water supply request for warm water use from the hot water tap 32*a*. As described above, when the hot-water supply flow rate sensor 25 detects a predetermined hot-water supply flow rate or higher due to the opening of the hot water tap 32*a*, since the incoming water temperature is lowered due to the entry of tap water, it can be determined that there is a hot-water supply request for warm water use from the hot water tap 32*a*. If the determination is "Yes", i.e., if there is a hot-water supply request, the process proceeds to S4, the hot-water supply operation is prioritized until warm water use is ended, and the process returns. If the determination is "No", i.e., if there is a temperature-maintaining request for maintaining the temperature of the hot-water supply pipe 32 due to the instantaneous hot water operation, the process proceeds to S5.

Next, in S5, it is determined whether the temperature-maintaining request is due to a start operation of the instantaneous hot water operation by the user of the instantaneous hot-water system H. S5 is a determination step of Condition 1 above, and for example, if the start operation of the instantaneous hot water operation directly precedes the temperature-maintaining request, it can be determined that it is due to the operation of the user. If the determination is "Yes", the process proceeds to S6, and in S6, the hot-water supply operation is prioritized reflecting the operation of the user for a predetermined period starting from the input of the initial temperature-maintaining request by the start operation of the instantaneous hot water operation performed by the user. The predetermined period in which the hot-water supply operation is prioritized is a period required for the preparation of warm water of the hot-water supply pipe 32, and is preset according to the specification (hot-water supply performance of the heating and hot-water supply apparatus 1 and length of the hot-water supply pipe 32) of the heating and instantaneous hot-water system H. If the determination is "No", the temperature-maintaining request is due to the temperature of the warm water of the hot-water supply pipe 32 being less than the hot-water supply setting temperature, and the process proceeds to S7.

Next, in S7, it is determined whether the incoming water temperature is equal to or lower than a predetermined temperature, or whether a temperature difference between the incoming water temperature and the hot-water supply setting temperature is equal to or greater than a predetermined value. S7 is a determination step of Condition 2 above. It is determined whether the temperature of the warm water of the hot-water supply pipe 32 is so low as to increase the possibility of impairing the comfort of the user, and which condition is to be determined may be selected in advance from the operation terminal 6. If the determination is "Yes", the process proceeds to S8, and in S8, the hot-water supply operation is prioritized until the temperature-maintaining request is not present, and the process returns. If the determination is "No", the process proceeds to S9, and in S9, the heating operation is prioritized until the next temperature confirmation, and the process returns.

The action and effect of the heating and hot-water supply apparatus 1 of the disclosure will be described.

The heating and hot-water supply apparatus 1 incorporated in the heating and instantaneous hot-water system H performs the heating operation when there is a heating request, and performs the hot-water supply operation when there is a hot-water supply request or a temperature-maintaining request. Then, when there is a hot-water supply request in addition to the heating request, the hot-water supply operation is prioritized, and when there is a temperature-maintaining request in addition to the heating request, the heating operation is prioritized. Therefore, the heating and hot-water supply apparatus 1 can prioritize the hot-water supply operation when the user uses warm water, and can prioritize the heating operation when the user does not use warm water. Accordingly, the operation to be prioritized can be changed according to the purpose of the hot-water supply operation, and comfort of the user can be improved.

In addition, the heating and hot-water supply apparatus 1 prioritizes the hot-water supply operation for maintaining the temperature of the warm water of the hot-water supply pipe 32 when the above predetermined conditions are satisfied, even in the case where there is a temperature-maintaining request in addition to the heating request and the heating operation is prioritized, i.e., even in the case where the heating operation is prioritized since the user does not use warm water. Therefore, when there is a temperature-maintaining request in addition to the heating request, the heating operation is prioritized, but it is possible to change to prioritize the hot-water supply operation to improve the comfort of the user.

Figure 3:
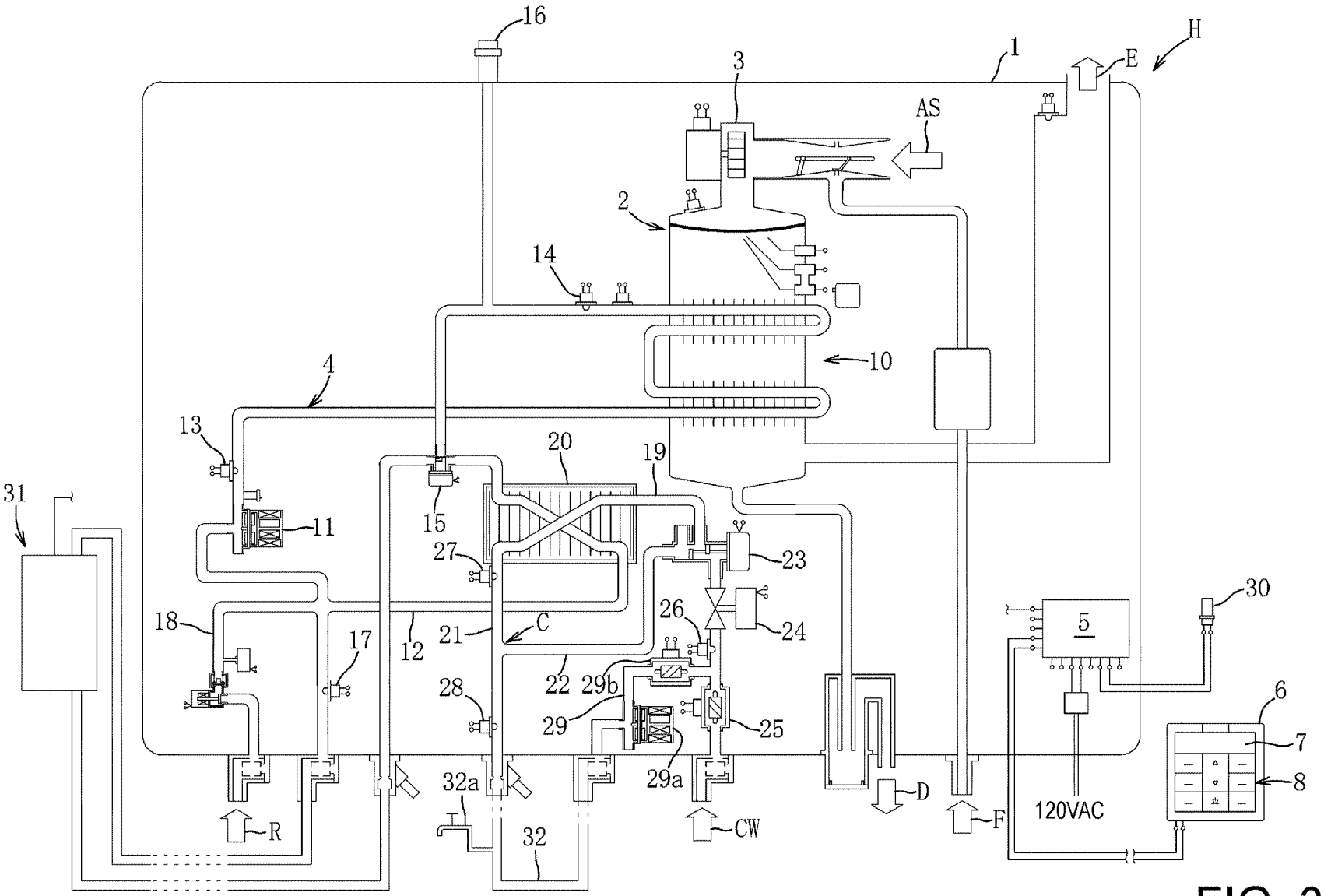
FIG. 3 is a view showing an example of a configuration in which the heating and hot-water supply apparatus is partially modified.

As shown in FIG. 3, the heating and hot-water supply apparatus 1 may also be configured to include an instantaneous hot water passage 29 for connecting the hot-water supply pipe 32 to the water entry passage 19, and a warm-water circulation pump 29*a* and a circulating water amount sensor 29*b* may be arranged in the instantaneous hot water passage 29. By also using the circulating water amount sensor 29*b*, it is possible to easily determine the purpose of the hot-water supply operation. Further, the heating and hot-water supply apparatus 1 may be applied to an instantaneous hot-water system capable of performing a simultaneous heating and hot-water supply operation to improve the comfort when it is difficult to perform the simultaneous heating and hot-water supply operation since the load of heating or hot water supply is large. In addition, a person skilled in the art can implement the embodiments in forms in which various modifications are added to the above-described embodiments without departing from the spirit of the disclosure, and the disclosure includes such modification forms.

What is claimed is:

1. A heating and hot-water supply apparatus comprising:

a combustor;

a heat exchanger for heating a heating heat-medium by heat generated by the combustor;

a circulation passage connecting an external heating terminal and the heat exchanger;

a circulation pump arranged in the circulation passage to circulate the heating heat-medium;

a bypass passage branched off from the circulation passage and bypassing the heating terminal;

a valve arranged at a branching part of the bypass passage;

a hot-water supply heat exchanger arranged in the bypass passage;

a water entry passage supplying water of a hot-water supply pipe and an external water supply pipe to the hot-water supply heat exchanger, wherein the hot-water supply pipe is provided with a warm-water circulation pump for circulating warm water, and a hot water tap is arranged at a warm water use spot;

a hot-water supply passage for supplying water heated by the hot-water supply heat exchanger to the hot-water supply pipe at a predetermined hot-water supply setting temperature; and a controller controlling the valve to be adaptable to each of a heating operation of supplying the heating heat-medium to the heating terminal and a hot-water supply operation of supplying hot water to the hot-water supply pipe, wherein the controller prioritizes the hot-water supply operation when there is a hot-water supply request for warm water use in addition to a heating request, and prioritizes the heating operation when there is a temperature-maintaining request for maintaining a temperature of the hot-water supply pipe in addition to the heating request.

2. The heating and hot-water supply apparatus according to claim 1, comprising an operation terminal communicably connected to the controller, wherein when there is the temperature-maintaining request in addition to the heating request, if the temperature-maintaining request is due to an operation of the operation terminal, the controller prioritizes the hot-water supply operation for a predetermined period starting from when the temperature-maintaining request is made.

3. The heating and hot-water supply apparatus according to claim 1, comprising an incoming water temperature detection sensor provided in the water entry passage and detecting an incoming water temperature of water entering the hot-water supply heat exchanger, wherein when there is the temperature-maintaining request in addition to the heating request, the controller prioritizes the hot-water supply operation during a period in which the incoming water temperature is lower than a predetermined temperature determined according to the hot-water supply setting temperature.

4. The heating and hot-water supply apparatus according to claim 1, comprising an incoming water temperature detection sensor provided in the water entry passage and detecting an incoming water temperature of water entering the hot-water supply heat exchanger, wherein when there is the temperature-maintaining request in addition to the heating request, the controller prioritizes the hot-water supply operation during a period in which a temperature difference obtained by subtracting the incoming water temperature from the hot-water supply setting temperature is equal to or greater than a predetermined value.

5. The heating and hot-water supply apparatus according to claim 2, comprising an incoming water temperature detection sensor provided in the water entry passage and detecting an incoming water temperature of water entering the hot-water supply heat exchanger, wherein when there is the temperature-maintaining request in addition to the heating request, the controller prioritizes the hot-water supply operation during a period in which the incoming water temperature is lower than a predetermined temperature determined according to the hot-water supply setting temperature.

6. The heating and hot-water supply apparatus according to claim 2, comprising an incoming water temperature detection sensor provided in the water entry passage and detecting an incoming water temperature of water entering the hot-water supply heat exchanger, wherein when there is the temperature-maintaining request in addition to the heating request, the controller prioritizes the hot-water supply operation during a period in which a temperature difference obtained by subtracting the incoming water temperature from the hot-water supply setting temperature is equal to or greater than a predetermined value.

* * * * *